US006111521A

United States Patent [19]

Mulder et al.

[11] Patent Number: 6,111,521

[45] **Date of Patent: *Aug. 29, 2000**

[54] APPARATUS FOR SUPPLYING TRAFFIC-RELATED INFORMATION

[75] Inventors: Edwin W. Mulder; Erik J. Walgers; Carla J. M. Emmerink; Paul D. M. E. Lahaije, all of Eindhoven, Netherlands

[73] Assignee: Mannesmann VDO AG, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/826,917

[22] Filed: Apr. 9, 1997

[30] Foreign Application Priority Data

Sep. 18, 1996 [EP] European Pat. Off. ..... 96202607

[51] Int. Cl.[7] ..... G08G 1/123

[52] U.S. Cl. ..... 340/905; 340/988; 340/992; 340/995; 701/204

[58] Field of Search ..... 340/905, 992, 340/994, 995, 988; 701/200, 204, 207, 208, 209, 213

[56] References Cited

U.S. PATENT DOCUMENTS

| | | | |
|---|---|---|---|
| 4,196,412 | 4/1980 | Sluis et al. | 340/905 |
| 5,095,532 | 3/1992 | Mardus | 455/186 |
| 5,164,904 | 11/1992 | Sumner | 364/436 |
| 5,173,691 | 12/1992 | Sumner | 340/905 |
| 5,257,023 | 10/1993 | Furuya | 340/995 |
| 5,293,163 | 3/1994 | Kakihara et al. | 340/905 |
| 5,504,482 | 4/1996 | Schreder | 340/995 |
| 5,568,390 | 10/1996 | Hirota et al. | 364/449 |
| 5,635,924 | 6/1997 | Tran et al. | 340/905 |
| 5,636,245 | 6/1997 | Ernst et al. | 375/259 |
| 5,712,632 | 1/1998 | Nishimura et al. | 340/995 |
| 5,784,691 | 7/1998 | Ruhl | 455/186.1 |
| 5,892,463 | 4/1999 | Hikita et al. | 340/905 |
| 5,900,825 | 5/1999 | Pressel et al. | 340/905 |

FOREIGN PATENT DOCUMENTS

| | | | |
|---|---|---|---|
| 0478438A1 | 4/1992 | European Pat. Off. | G08G 1/0969 |
| 2276063 | 9/1994 | United Kingdom | 340/905 |

OTHER PUBLICATIONS

"Location Referencing Rules for RDS–TMC", European Road Transport Telematics Implementation Coordination Organisation, Task Force on Geographical Location Referencing, CORD Project V 2056, Deliverable No. D010, Aug. 1995.

European pre–standard prENV/278/4/1/0010, English Version, Traffic and Traveller Information (TTI), Version 2.01, Revised Version, Oct. 1995.

Event List (Normative) prENV/278/4/1/0009, Annex A, Oct. 23, 1995.

*Primary Examiner*—Daniel J. Wu

*Attorney, Agent, or Firm*—David M. Thimmig; Mayer Brown & Platt

[57] ABSTRACT

An apparatus for supplying traffic-related information in a vehicle receives a message concerning a traffic-related event, for instance a traffic queue. This message contains information about the location of the traffic-related event. The apparatus calculates the time and/or distance interval between the location of the event and the current position of the vehicle and gives an alarm if the time and/or distance interval is smaller than a predetermined time and/or distance interval.

20 Claims, 1 Drawing Sheet

APPARATUS FOR SUPPLYING TRAFFIC-RELATED INFORMATION

BACKGROUND OF THE INVENTION

The invention relates to an apparatus for supplying traffic-related information in a vehicle, the apparatus comprising a receiver for the reception of a message including a location of a traffic-related event and comprising means for receiving an actual position of the vehicle.

The invention further relates to a method for supplying traffic-related information in a vehicle, the method comprising the steps of:

sending a message including a location of a traffic-related event, in the vehicle receiving the message, and ascertaining an actual position of the vehicle.

Such apparatus and method are known from the European patent application published under number EP 0 478 438 A1. The known apparatus includes a receiver for receiving a message included in the RDS-TMC (Radio Data System—Traffic Message Channel) signal concerning a problem on a certain road segment. The known apparatus determines the location of the road segment and displays that road segment on a map in a colour that is different from the other road segments. Consultation of the map, gives a user of the apparatus an overview of road segments for which a problem is reported to exist.

OBJECTS AND SUMMARY OF THE INVENTION

It is an object of the invention to provide an apparatus of the kind set forth which offers the user a larger functionality than the known apparatus. This object is achieved according to the invention in an apparatus that is characterised in that the apparatus further comprises calculation means for calculating an actual time and/or distance interval between the actual position of the vehicle and the location of the event and alarm means for giving an alarm when the actual time or distance interval is smaller than a predetermined minimal time and/or distance interval. By giving an alarm when the vehicle is closer, either in time or in distance, to the location of a traffic-related event than a minimal, safe time or distance interval, the apparatus according to the invention informs the user of a potential dangerous situation. The user can then anticipate the particular event and is not taken by surprise. The apparatus using a time interval for determining whether and when an alarm should be given, takes the actual speed of the vehicle into account and will give the alarm for a user travelling at a high speed a longer distance ahead of the event than for a user travelling at a lower speed. The apparatus according to the invention contributes significantly to the safety of the traffic on the roads.

An embodiment of the apparatus according to the invention is characterised in that the apparatus has means for storing a predetermined route to be followed by the vehicle, and that the calculation means are arranged for calculating the actual time and/or distance interval to go along the predetermined route between the actual position of the vehicle and the location of the event. By considering the predetermined route, the apparatus according to the invention can more adequately inform the user of an imminent traffic-related event. The time and/or distance interval to the location of the event can be more precisely calculated because the road expected to be travelled by the vehicle is used in determining that interval. Furthermore, it can be better decided whether a particular traffic-related event is relevant to the user, by simply determining whether the predetermined route will bring the vehicle to the event.

An embodiment of the apparatus according to the invention is characterised in that the apparatus further comprises means for storing an indication of the class of roads along the predetermined route and that the alarm means are arranged to adapt the minimal time or distance interval in dependence on the road class at the location of the traffic-related event and/or at the actual position of the vehicle. By taking into account the information indicative for the road, e.g. the class of road, the apparatus according to the invention can more adequately the inform the user of the imminent traffic-related event. For instance, a user travelling on a motorway needs to receive the alarm a larger distance ahead of the location of the event than the user travelling in a village.

An embodiment of the apparatus according to the invention is characterised in that the apparatus further comprises means for storing junctions of the predetermined route and that the alarm means are arranged to give the alarm prior to the junction directly preceding the location of the traffic-related event. By giving the user the alarm prior to the junction directly preceding the event, the user can leave the predetermined route at that junction rather than following that route and entering the road segment with the event. This embodiment is particular advantageous to warn the user in case there is an event, e.g. a traffic queue or dense fog, on a particular road segment of the predetermined route, so that the user can leave that route and take an alternative one.

An embodiment of the apparatus according to the invention is characterised in that the alarm means are arranged to give a warning prior to giving the alarm. By giving a warning a longer period in advance and an alarm when close to the event, the apparatus offers the user a longer time to prepare for the event while still offering the alarm function when the vehicle is close to the event. The warning can be used to increase the preparedness of the user and/or to offer the user the possibility of choosing an alternative route.

An embodiment of the apparatus according to the invention is characterised in that the alarm means are arranged to give the alarm as including an acoustic signal. It is advantageous to provide a driver of a vehicle with an acoustic warning or alarm. Then the driver can be informed while at the same time remaining able to pay attention to the road and to the other traffic.

An embodiment of the apparatus according to the invention is characterised in that the traffic-related event comprises a traffic queue. By alarming that there is a traffic queue ahead, an accident whereby the vehicle runs into the queue can be avoided.

An embodiment of the apparatus according to the invention is characterised in that the message comprises an RDS-TMC message. An RDS-TMC message offers the possibility of specifying the nature and the location of one of various traffic-related events in a standardised way.

It is a further object of the invention to provide a method of the kind set forth in the preamble which offers a larger functionality than the known method. This object is achieved according to the invention in a method that is characterised in that the method further comprises the steps of:

calculating an actual time and/or distance interval between the actual position of the vehicle and the location of the event, and giving an alarm when the actual time or distance interval is smaller than a predetermined minimal time and/or distance interval.

The method gives an alarm when a potential dangerous situation arises and thus contributes to the safety of traffic on the roads.

The invention and its attendant advantages will be further elucidated with the aid of exemplary embodiments and the accompanying schematic drawings, whereby:

DETAILED DESCRIPTION OF THE PREFERRED EMBODIMENT

Figure 1:
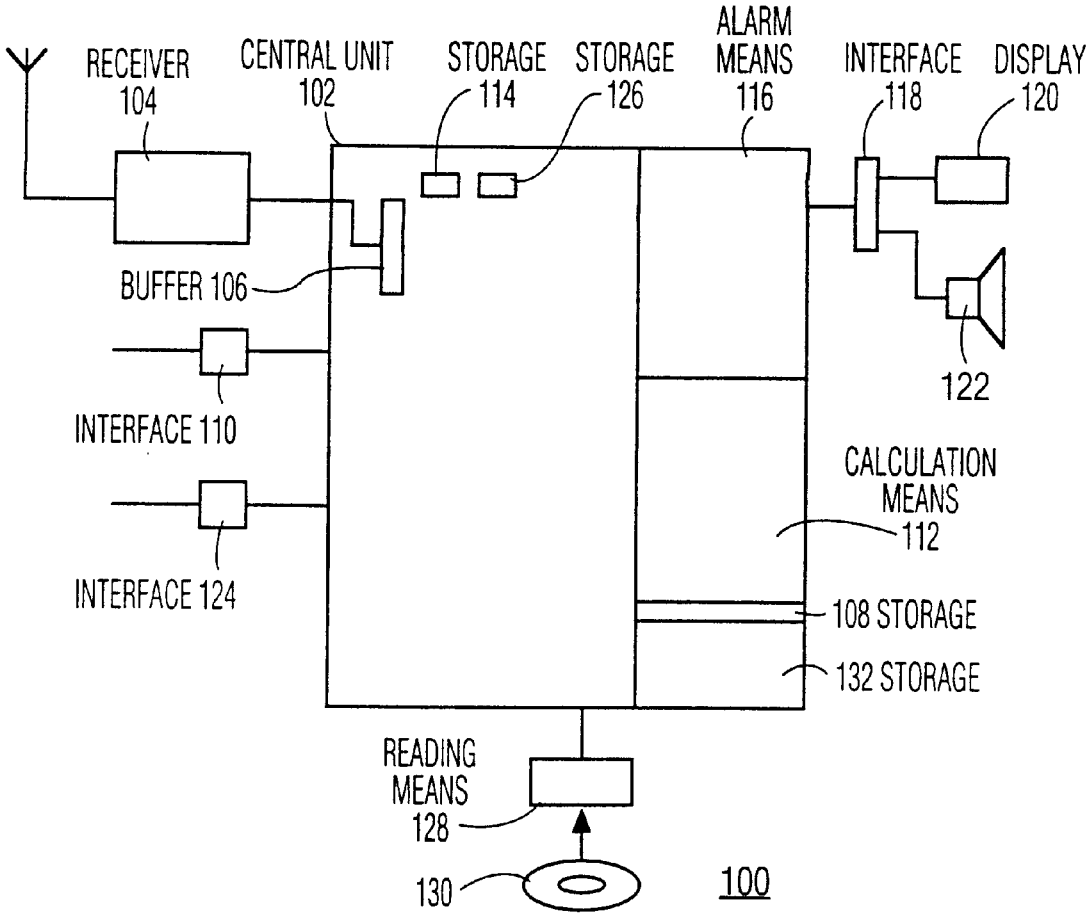
FIG. 1 schematically shows a number of elements of an apparatus according to the invention, and FIG. 2 schematically shows an example of a traffic-related event.
Figure 2:
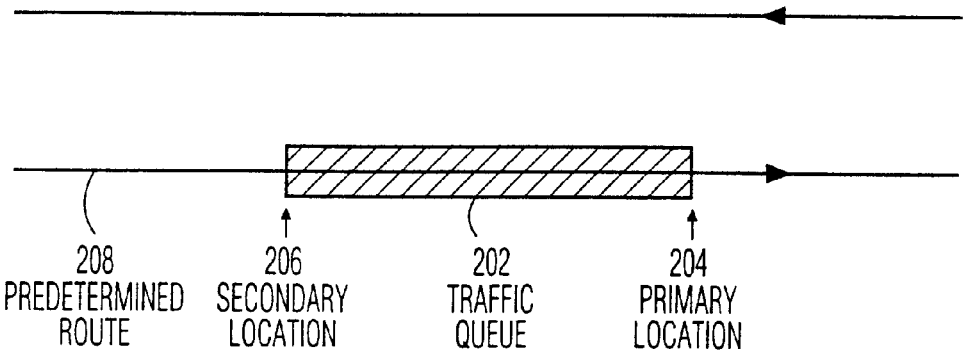

FIG. 1 schematically shows a number of elements of an apparatus according to the invention. The apparatus 100 comprises a central unit 102 which controls the operation of the apparatus and which includes various sub-units for performing specific tasks. The central unit can be implemented as a central processing unit, comprising a processor and working memory loaded with various software modules for carrying out the specific tasks. The apparatus 100 comprises a receiver 104 for receiving a broadcast message. Such message can contain a traffic-related event, such as dense fog in a certain area or a traffic queue on a certain road, including the location of the particular event. A traffic-related event in this context is understood to be an event, situation or condition, of which the information is relevant to traffic near its location. When successive messages are received and to be processed, the data of the respective events then can be stored in a buffer 106 of the apparatus. The apparatus further comprises storage space 108 for storing a route which is intended to be followed by the vehicle in which the apparatus is used. The apparatus 100 is equipped with an interface 110 suitable for receiving information concerning the actual position of the vehicle. This information can be supplied by a position determining system like GPs receiver, using information broadcast by dedicated satellites. However, the position information can also be determined in another way, for instance using a system with one or more distance sensors, for measuring the distance travelled by the vehicle, and a compass, for measuring the heading of the vehicle. Furthermore, the apparatus has calculation means 112 for calculating the distance along the predetermined route between the actual position of the vehicle and the location of one or more of the received traffic-related events. When this calculated distance is less than a predetermined distance, stored in storage space 114, the apparatus gives an alarm. To this end, the apparatus comprises alarm means 116 and an interface 118 for sending the alarm to display 120 and/or loudspeaker 122. Also another means for generating a visual indication for the driver can be used, e.g. a flashing light on the dashboard. The generation of an acoustic alarm can not only be realised via loudspeaker 122 but also via another device, e.g. a piezo-electric element generating a beep. Alternatively to, or in addition to, giving an alarm when the vehicle is too close in distance to the traffic-related event, the apparatus can be arranged to give an alarm when the time to travel to the event is shorter than a predetermined time. For this option, the apparatus has an interface 124, for receiving the actual speed of the vehicle, and storage space 126, for storing the predetermined time interval. The actual speed of the vehicle can be obtained in various ways, e.g. through a speed sensor of the vehicle or through a GPS-system receiving navigation signals. The calculation means 112 are then arranged to calculate how much time it will take to travel the calculated distance between the actual position of the vehicle and the location of one or more of the events. Subsequently, the alarm means will then give an alarm if this calculated time is shorter than the time interval stored in space 126. The apparatus described above includes storing a predetermined, pre-programmed route that is followed by the vehicle. That apparatus calculates the time or distance interval between events along that route and the actual position of the vehicle. However, in a more simple alternative, the apparatus does not include storing the predetermined route and the calculation means are arranged to calculate the time or distance interval between the location of an event on the road segment the vehicle is currently travelling and the actual position of the vehicle.

The apparatus according to the invention can be arranged to be responsive to certain types of traffic-related events only. Message comprising other types of traffic-related events are not processed and no alarm or warning will be given for them. In such an apparatus it could be implemented for the user to indicate the type or types of traffic-related event for which an alarm or warning need be given. The user may then for instance indicate that only traffic queues must give rise to an alarm or warning.

In an embodiment the apparatus gives a warning for the traffic-related event in addition to the actual alarm. The warning can be used to increase the preparedness of the user and/or to offer the user the possibility of choosing an alternative route. The moment of giving the warning can be derived from the predetermined distance stored in storage space 114 and/or on the predetermined time interval stored in storage space 126. The stored values can for instance be doubled or quadrupled or otherwise transformed in order the determine the actual giving of the warning. Alternatively, a separate minimal distance or time interval can be stored specifically for giving the warning. While the warning in this embodiment is used to warn the user a longer period in advance, the alarm retains its function for alarming the user that immediate attention is required concerning some imminent, potentially dangerous situation.

In a further embodiment, the apparatus can be equipped with reading means 128 to read road information concerning the predetermined route from a data carrier 130 and store this information in storage space 132. The carrier can be an optical disc, like a CD-ROM, a magnetic disc, memory card or other memory device. In this particular embodiment, it concerns information that is indicative for the speed to be expected for that road. An example of this indicative information the classification of the roads, indicating the type of the road. Types of road in this embodiment are: motorway, highway, main road, primary road connector, local connector, local road, and restricted access road. The type of the road on which the vehicle is travelling and/or the type of the road at the location of the traffic-related event are of importance for determining how far ahead of the location the alarm needs to be given. When for instance, there is a traffic queue on the predetermined route of the vehicle, a distinction will be made whether the queue is on a motorway or on a service road in a village. The user of the apparatus must receive the alarm for a queue on the motorway a much larger distance ahead then the alarm for a queue on the service road. Therefore, the alarm means of this embodiment are arranged to adapt the minimal distance and/or time interval used for determining the actual giving of the alarm.

In another embodiment, the road information read from the data carrier and stored in storage space 132 includes the topology of the roads forming the predetermined route. In particular the locations of the junctions along that route are included so that it is known at which locations the vehicle can leave the route. In this context, junctions are understood to be points were a driver of a vehicle has an option to change his route and include among others crossings, motorway exits, Y-junctions. Furthermore, the alarm means are arranged to give the warning or the alarm for a particular traffic-related event prior to the junction directly preceding the event. This gives the user of the apparatus the possibility of leaving the route at that junction and avoiding the traffic-related event all together. This is particular advantageous in case of a traffic queue on a motorway, where it is usually very difficult to leave the motorway when one is stuck in the traffic queue. The apparatus according to this embodiment will in such a case give a warning prior to the exit where one can still leave the motorway without getting stuck in the traffic queue.

In an embodiment of the invention, the messages with a traffic-related event are specified according to the European pre-standard prENV/278/4/1/0010. Such a message contains among others the nature of the event, the location of the event and if applicable the extent of the event. Annex A of the pre-standard contains a list with the many possible messages. Some examples of the various possibilities are: traffic queue, accident, road closure, lane closure, roadworks, ice on road, snow on road, heavy rain, dense fog, and strong winds. The messages are standardised and will be used to disseminate traffic and traveller information via broadcast services. New broadcasting techniques enable the traffic messages being carried digitally and silently together with the traditional audio information without interrupting the audio program. This is called Radio Data Systems and its application for traffic messages is known as Traffic Message Channel.

This example concerns a traffic queue 202, extending from a primary location 204 to a secondary location 206. Through convention, the primary location is the head of the queue, i.e. the end of the queue that is furthest down the predetermined route 208 as seen from the actual position of the vehicle, and the secondary location is the tail of the queue, i.e. the end of the queue that is closest to the vehicle. The apparatus according to the invention determines the actual giving of the warning or alarm for a traffic-related event with two locations, like the traffic queue, on the basis of the secondary location. The document "Location Referencing Rules For RDS-TMC", European Road Transport Telematics Implementation Co-ordination Organisation, Task Force on Geographical Location Referencing, CORD Project V 2056, Deliverable No D010, August 1995, describes a number of ways for specifying the primary and secondary locations of a traffic-related event. Both locations can be given as pre-defined locations. In that case potential relevant locations are defined in advance and are transferred in a message as a code number referring to the particular pre-defined location at hand. Hereby the extent of an event is specified as a number of pre-defined locations in a given direction. It is also possible to specify the primary location as a pre-defined location and to specify the secondary location implicitly by giving the extent of the event. The extent can be given as the number of pre-defined locations which are affected by the event or as the length of the event in kilometers. Alternatively it is possible to specify the primary location, and if applicable the secondary location, in the form of distance markers which are defined for the road which is affected by the event. As a further alternative it is possible to specify a location in geometric co-ordinates in a coordinate system agreed upon by the sender and recipients of the messages.

What is claimed is:

1. An apparatus for supplying traffic-related information in a vehicle, the apparatus comprising a receiver for the reception of a message including a primary and secondary location constituting the beginning and end of a traffic-related event and comprising means for receiving an actual position of the vehicle characterized in that the apparatus further comprises calculation means for calculating an actual time and/or distance interval between the actual position of the vehicle and the secondary location of the event and alarm means for giving an alarm when the actual time or distance interval is smaller than a predetermined minimum time and/or distance interval.

2. An apparatus according to claim 1, characterized in that the apparatus has means for storing a predetermined route to be followed by the vehicle, and that the calculation means are arranged for calculating the actual time and/or distance interval to travel along the predetermined route between the actual en-route position of the vehicle and the actual location of the event.

3. An apparatus according to claim 2, characterized in that the apparatus further comprises means for storing an indication of the class of roads along the predetermined route and that the alarm means are arranged to adapt the minimum time or distance interval in dependence on the road class at the actual location of the traffic-related event and/or at the actual position of the vehicle.

4. An apparatus according to claim 2, characterized in that the apparatus further comprises means for storing junctions of the predetermined route and the alarm means are arranged to use the stored junction information to give the alarm prior to the junction directly preceding the actual location of the traffic-related event.

5. An apparatus according to claim 1, characterized in that the alarm means are arranged to give a warning when the actual time or distance interval is smaller than a second predetermined minimum time and/or distance interval prior to giving the alarm.

6. An apparatus according to claim 1, characterised in that the alarm means are arranged to give the alarm as including an acoustic signal.

7. An apparatus according to claim 1, characterised in that the traffic-related event comprises a traffic queue.

8. An apparatus according to claim 1, characterised in that the traffic-related event comprises reduced visibility on a road segment.

9. An apparatus according to claim 1, characterised in that the traffic-related event comprises a dangerous condition of a road segment.

10. An apparatus according to claim 1, characterised in that the message comprises an RDS-TMC message.

11. A method of supplying traffic-related information in a vehicle, the method comprising the steps of:

sending a message including a primary and secondary location constituting the beginning and end of a traffic-related event receiving the message in the vehicle, and ascertaining an actual position of the vehicle, characterized in that the method further comprises the steps of:

calculating an actual time and/or distance interval between the actual position of the vehicle and the secondary location of the event, and giving an alarm when the actual time or distance interval is smaller than a predetermined minimum time and/or distance interval.

12. A method of supplying traffic-related information in a vehicle according to claim 11, further comprising the steps of:

storing a predetermined route to be followed by the vehicle, and calculating the actual time and/or distance interval to travel along the predetermined route between the actual en-route position of the vehicle and the actual location of the event.

13. A method of supplying traffic-related information in a vehicle according to claim 12, further comprising the steps of:

storing an indication of the class of roads along the predetermined route, and adjusting the minimum time or distance interval in dependence on the road class at the actual location of the traffic-related event and/or at the actual position of the vehicle.

14. A method of supplying traffic-related information in a vehicle according to claim 11, further comprising the steps of:

determining junctions of the predetermined route, storing the junctions of the predetermined route, and giving an alarm prior to the vehicle reaching the junction directly preceding the actual location of the traffic-related event.

15. A method of supplying traffic-related information in a vehicle according to claim 11, further comprising the step of:

giving a warning when the actual time or distance interval is smaller than a second predetermined minimum time and/or distance interval prior to giving the alarm.

16. An apparatus for supplying traffic-related information in a vehicle, the apparatus comprising a receiver for the reception of a message including an actual location of a traffic-related event and the actual position of the vehicle, means for storing a predetermined route to be followed by the vehicle, a calculation means for calculating an actual time and/or distance interval to travel along the predetermined route between the actual en-route position of the vehicle and the actual location of the event, and alarm means for giving an alarm when the actual time or distance interval is smaller than a predetermined minimum time and/or distance interval, wherein the alarm means configured to activate only for a user-specified traffic-related event or events.

17. An apparatus according to claim 16, characterized in that the apparatus further comprises means for storing an indication of the class of roads along the predetermined route and that the alarm means are arranged to adapt the minimum time or distance interval in dependence on the road class at the actual location of the traffic-related event and/or at the actual position of the vehicle.

18. An apparatus according to claims 16, characterized in that the apparatus further comprises means for storing junctions of the predetermined route and the alarm means are arranged to use the stored junction information to give the alarm prior to the junction directly preceding the actual location of the traffic-related event.

19. An apparatus according to claim 16, characterized in that the alarm means are arranged to give a warning when the actual time or distance interval is smaller than a second predetermined minimum time and/or distance interval prior to giving the alarm.

20. An apparatus according to claim 16, characterized in that the alarm means are arranged to give the alarm as including an acoustic signal.

* * * * *